US007140511B2

(12) United States Patent
Baker et al.

(10) Patent No.: US 7,140,511 B2
(45) Date of Patent: Nov. 28, 2006

(54) DISPENSER WITH STOWABLE COVER

(75) Inventors: Paul Joseph Baker, Saylorsburg, PA (US); Robert Croft, Jersey City, NJ (US); Sergio Gedanke, Brooklyn, NY (US); Richard Hirst, Teaneck, NJ (US); Insun Yun, New York, NY (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 11/211,425

(22) Filed: Aug. 26, 2005

(65) Prior Publication Data

US 2005/0279754 A1 Dec. 22, 2005

Related U.S. Application Data

(63) Continuation of application No. 10/253,880, filed on Sep. 25, 2002, now abandoned.

(51) Int. Cl.
*B65D 43/14* (2006.01)

(52) U.S. Cl. ..... 220/813; 206/701

(58) Field of Classification Search ..... 220/345.1, 220/811–818, 345.2, 291; 206/701
See application file for complete search history.

(56) References Cited

U.S. PATENT DOCUMENTS

| | | | | |
|---|---|---|---|---|
| 391,145 | A | 10/1888 | Hardin | 229/125.11 |
| 400,006 | A | 3/1889 | Page | |
| 407,972 | A | 7/1889 | Springer | |
| 2,979,223 | A | 4/1961 | Rideout | 220/38 |
| 3,741,430 | A | 6/1973 | Bergh et al. | 220/38 |
| 3,833,143 | A | 9/1974 | Starkermann et al. | 220/345 |
| 3,888,350 | A | 6/1975 | Horvath | 206/531 |
| 4,095,712 | A | 6/1978 | Perrella | 220/254 |
| 4,113,098 | A | 9/1978 | Howard | 206/540 |
| 4,126,224 | A | 11/1978 | Laauwe et al. | 206/540 |
| 4,144,985 | A | 3/1979 | Kinslow | 220/254 |
| 4,538,731 | A | 9/1985 | Cillario | 206/540 |
| 4,615,461 | A | 10/1986 | Liu | 220/815 |
| 5,203,469 | A | 4/1993 | Chang et al. | 220/331 |
| 5,273,177 | A | 12/1993 | Campbell | 220/281 |
| 5,353,947 | A | 10/1994 | Zinnbauer et al. | 220/812 |
| 5,636,732 | A | 6/1997 | Gilels et al. | 206/37 |
| 5,709,305 | A | 1/1998 | Essig et al. | 206/536 |
| 5,718,347 | A | 2/1998 | Walker et al. | 215/209 |
| 6,129,237 | A | 10/2000 | Miyahara | 220/812 |
| 6,196,405 | B1 | 3/2001 | Kambouries | 220/4.22 |
| 6,367,642 | B1 | 4/2002 | Kambouries et al. | 220/4.22 |

*Primary Examiner*—Lien M. Ngo
(74) *Attorney, Agent, or Firm*—Fitzpatrick, Cella, Harper & Scinto

(57) ABSTRACT

A dispenser for small objects, such as candy, pills, tablets, and other objects of similar size. The dispenser includes a housing having a bottom, a front wall, a rear wall and two opposing side walls. The housing defines an interior volume and an aperture providing access to the interior volume. A cover is movably attached to the housing and has a closed position for securing objects within the interior volume and at least one opened position for displaying and/or dispensing the objects from the interior volume. Two flanges depend from the cover. The flanges are functionally engaged respectively with the sides walls of the housing such that the cover is laterally movable with respect to the housing, selectively rotatable about an axis defined in the housing, and movable into the closed and opened positions including a stowed position in which the cover is opened, the cover is substantially flush with the housing and, except for the thickness of the cover, the cover does not extend substantially beyond the planes of the front wall and the side walls.

8 Claims, 13 Drawing Sheets

FIG. 4
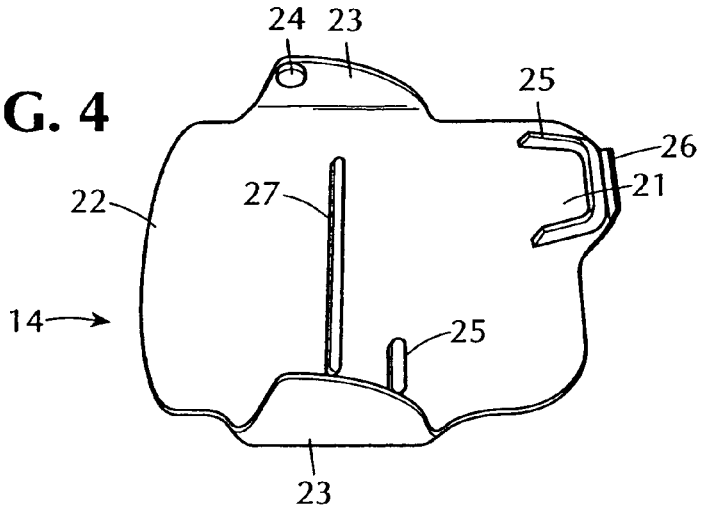
FIG. 5A
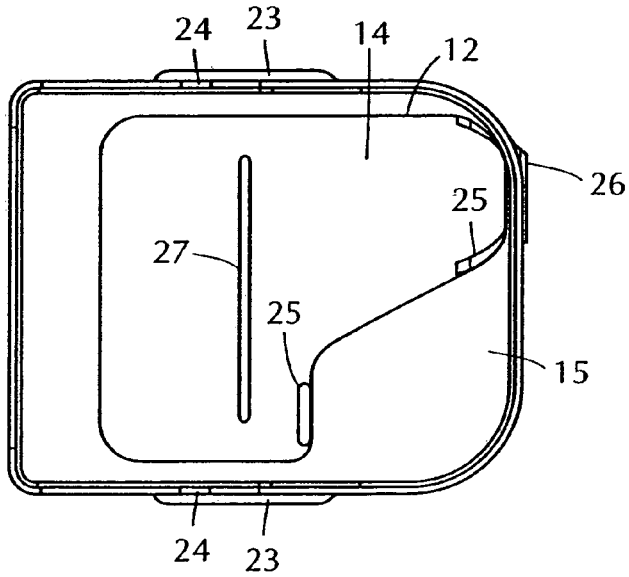
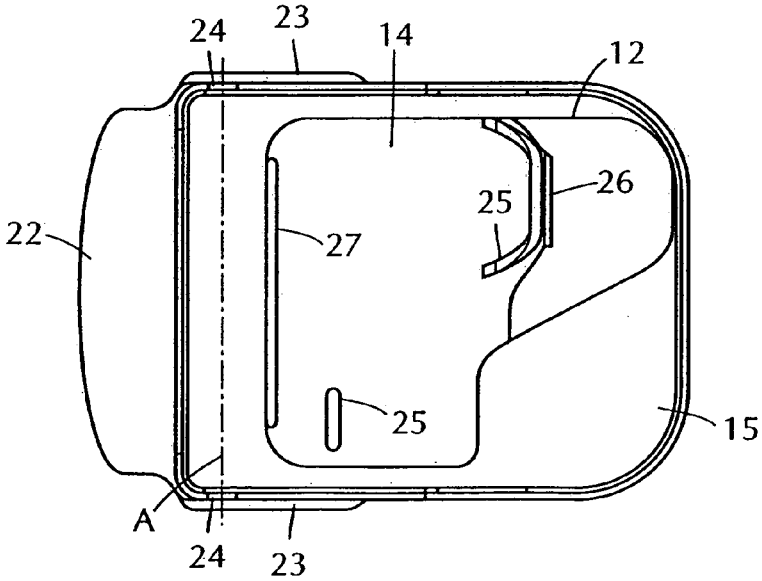
FIG. 5B

DISPENSER WITH STOWABLE COVER

This application is a continuation of U.S. patent application Ser. No. 10/253,880 filed Sep. 25, 2002 now abandoned.

BACKGROUND OF THE INVENTION

1. Field of the Invention

The present invention generally relates to a dispenser for small objects, such as candy, pills, tablets, and other objects of similar size. In particular, the present invention relates to a dispenser having a housing and a cover that can be opened to multiple different stable opened positions, including a stowed position in which the cover is substantially flush with the housing and does not extend substantially beyond the boundaries of the housing.

2. Related Background Art

Dispensers for small objects, such as candy, pills, tablets, and other objects of similar size are well known in the art. Such dispensers take a variety of forms. For example, they may be formed of a hollow body and a separately formed top portion, the top portion comprising a flat surface having an aperture and a closure element that allows access to objects within the hollow body of the dispenser through the aperture when open, while securing objects within the hollow body when closed. Such dispensers may require lifting or pressing the closure element in order to open the aperture. Examples of dispensers of these types can be found in U.S. Pat. Nos. 4,538,731, 5,636,732, 4,144,985, 5,273,177 and 4,095,712.

Other dispensers comprise box-like containers with lids that slide open, e.g., U.S. Design Pat. No. 407,972, lids that rotate open, e.g., U.S. Pat. Nos. 2,979,223, 5,709,305 and 5,718,347, or lids that slide and rotate open, e.g., U.S. Pat. No. 3,741,430. Still other dispensers comprise box-like containers with drawers that slide out of the containers, e.g., U.S. Design Pat. No. 400,006 and U.S. Pat. Nos. 3,833,143, 3,888,350, 4,113,098 and 4,126,224. A number of these dispensers include locking mechanisms to keep the dispenser securely closed, for example, to prevent young children from having access to pills stored in the dispenser.

One problem of conventional dispensers such as those mentioned above is that, while such dispensers are generally designed to be compact, they tend to lose their compact size when they are placed in a fully opened position in order to dispense the contents. Thus, for example, in dispensers having a drawer, the drawer may be virtually the same size as the container, so that opening the drawer causes the dispenser to increase in size to up to twice its closed size. In dispensers having a lid, when the lid is opened the lid generally protrudes to a great extent, since the lid is often as wide or as long as one of the dimensions of the container.

While U.S. Pat. No. 5,203,469 discloses a tool box having a lid that can be stored flat against the bottom of the box, in order to store the lid in this fashion the lid must be disengaged from the box, inverted, and then reattached to the box. This is a cumbersome and inconvenient way of storing the lid and retaining the compact size of the opened box.

Another problem occurring in conventional dispensers is the inability to be opened into a plurality of different stable opened states, which are stably open to different degrees so as to allow different rates of dispensing. Thus some dispensers have only a single opened state, e.g., a state designed for dispensing a small amount of the contents or a state designed for dispensing the entire contents, but do not have both of these states or additional states which would allow for multiple dispensing rates.

Another problem occurring in conventional dispensers is accidental spillage. For example, some dispensers permit being opened only to a wide open state, in which accidental spillage can easily occur. Relatedly, other dispensers allow for a plurality of opened states whereby the dispenser can be opened to different degrees, but do not permit an opened state designed for dispensing only a small amount of the contents. Again, in some dispensers that allow for such a plurality of opened states, these states are not stable. That is, the user may not be able to rely on the dispenser's remaining in a particular (partly) opened state. Rather, the dispenser may easily, and without the user so intending, open itself to a wider opened state, which may cause the contents to spill out against the user's wishes. In addition, some conventional dispensers, especially those with locking mechanisms, such as childproof dispensers, require a significant amount of force to open them. When using such a dispenser, the user can easily unintentionally cause the dispenser to suddenly open to a state that is opened to a greater extent than desired, which can easily cause accidental spillage of the contents.

Another problem with conventional dispensers is the presence of protrusions, rough edges, sharp points or the like, which can snag or tear a user's clothing or scratch a user's hand. Such hindrances tend to be present especially when the dispensers are placed in an opened state, because in this state the door, flap, closure element, or the like, which often has a surface that is rough or jagged, generally protrudes from the dispenser and hangs free.

The present invention provides a dispenser that solves the above problems, as explained below.

SUMMARY OF THE INVENTION

The present invention is directed to a dispenser for storing and dispensing small objects, comprising a housing including a bottom, a front wall, a rear wall and two opposing side walls, the housing defining an interior volume and an aperture providing access to the interior volume. A cover is movably attached to the housing and has a closed position for securing objects within the interior volume and at least one opened position for displaying and/or dispensing the objects from the interior volume. Two flanges depend from the cover. The flanges are functionally engaged respectively with the sides walls of the housing such that the cover is laterally movable with respect to the housing, selectively rotatable about an axis defined in the housing, and movable into the closed and opened positions including a stowed position in which the cover is opened and the cover is substantially flush with the housing.

Yet another embodiment of this invention is directed to a dispenser for storing and dispensing small objects, comprising a housing including a bottom, a front wall, a rear wall and two opposing side walls, the housing defining an interior volume and an aperture providing access to the interior volume. A cover is movably attached to the housing and has a closed position for securing objects within the interior volume and at least one opened position for displaying and/or dispensing the objects from the interior volume. Two flanges depend from the cover. The flanges are functionally engaged respectively with the sides walls of the housing such that the cover is laterally movable with respect to the housing, selectively rotatable about an axis defined in the housing, and movable into the closed and opened positions including a stowed position in which the cover is opened and in which the cover does not extend substantially beyond planes of the front wall and the side walls.

Yet another embodiment of this invention is directed to a dispenser as in the previous embodiment wherein, when the cover is in the stowed position, the cover also does not extend substantially beyond the plane of the rear wall.

BRIEF DESCRIPTION OF THE DRAWINGS

FIG. 1A shows a cover of the dispenser in the fully closed position. FIG. 1B shows the cover in a first opened position. FIG. 1C shows the cover rotating. FIG. 1D shows the cover in a fully opened position. FIG. 1E shows the cover in a fully opened and stowed position.

FIG. 4 illustrates, from the underside, a cover of a dispenser of the invention disengaged from a housing.

FIGS. 5A and 5B are schematic views showing, when viewed from the interior or underside, the upper portion of the housing and portions of the cover visible through the aperture of the housing or around the edges of the upper portion of the housing. FIG. 5A shows the cover in a fully closed position, for illustrating the operation of stops in stopping the cover from moving beyond the front wall of the housing and the operation of the catch in locking the cover in the fully closed position. FIG. 5B shows the cover in a first stable opened position, for illustrating the operation of a rib in stabilizing the cover in the first stable opened position and in facilitating the shift in movement of the cover from sliding to rotating.

DETAILED DESCRIPTION OF THE INVENTION

The present invention is directed to a dispenser for small objects, such as candy, pills, tablets, and other objects having a similar size. As used herein the term "small objects" refers to pieces of candy, pills, tablets, and any other object having a similar size that may be stored in and dispensed from the dispenser of the invention.

First Embodiment

A first embodiment of the invention, with modifications, will now be described.

Figure 1A:
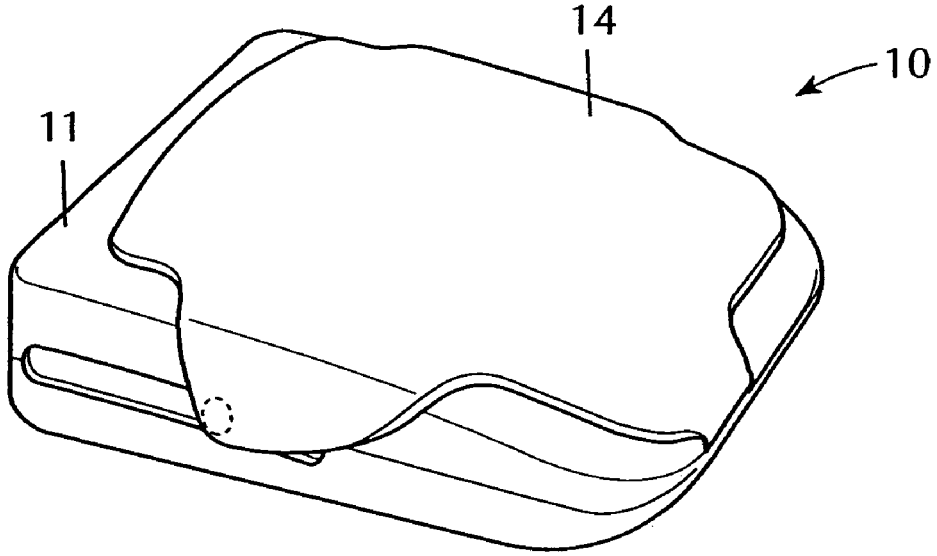
FIGS. 1A–1E are top perspective views of a dispenser of the invention. In particular.

A dispenser in accordance with the invention is generally illustrated in FIGS. 1A–1E, 2A–2E and 3A–3E. FIGS. 1A–1E show the dispenser in a top perspective view, with the cover in different positions from fully closed to fully opened and stowed. FIGS. 2A–2E show the dispenser in a bottom perspective view, with the cover in the same positions as shown in FIGS. 1A–1E. FIGS. 3A–3E illustrate schematic views of the relative movement and cooperative relationship between the components of the dispenser, with the cover in the same positions as shown in FIGS. 1A–1E. Dispenser 10 comprises a housing 11, a dispensing aperture 12 in housing 11, an interior volume 13 within housing 11, and a cover 14 removably and selectively movably attached to housing 11. Dispenser 10 is designed to hold and dispense candy or other small objects, such objects being visible in FIGS. 1B–1E. Cover 14 has a fully closed position, as illustrated in FIGS. 1A, 2A, and 3A, and multiple dispensing and displaying positions, selectively illustrated in FIGS. 1B–1E, 2B–2E and 3B–3E.

In this illustrated embodiment, dispenser 10 has a preferred shape of ergonomic curvature, although it will be readily appreciated that the shape may be altered. Housing 11 has a top 15, a bottom 16, a front wall 17, a rear wall 18, and parallel side walls 19. Bottom 16, rear wall 18, and side walls 19 are roughly planar, although with smoothed or rounded edges. Top 15 and front 17 are gently curved, also with smoothed or rounded edges. Top 15 is partly cut-out. Each of the two side walls 19 has a groove 20 provided therein.

Cover 14 comprises a front tab portion 21, a rear flap portion 22, and two side flanges 23 each overlapping a side wall 19 of housing 11. Each side flange 23 has a projection 24 provided therein facing side walls 19. Projections 24 fit into grooves 20 in side walls 19 such that cover 14 can slide back and forth along grooves 20. As shown, for example, in FIG. 3A, when cover 14 is slid forward, projections 24 are moved in grooves 20 in the direction of front wall 17. As shown, for example, in FIG. 3B, when cover 14 is slid backward, projections 24 are moved in grooves 20 in the direction of rear wall 18.

Figure 3A:
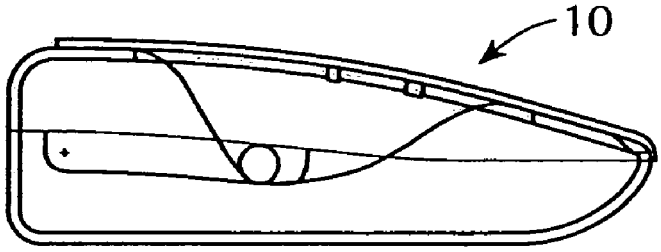
FIGS. 3A–3E are sequential schematic illustrations of the relative movement and cooperative relationship between the components of a dispenser of the invention. In these figures, the positions of the cover correspond respectively to those of FIGS. 1A–1E and 2A–2E.
Figure 3B:
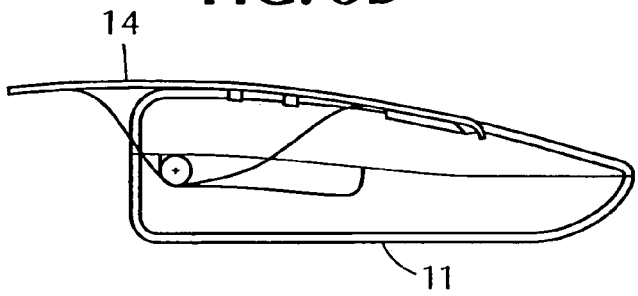
Figure 3C:
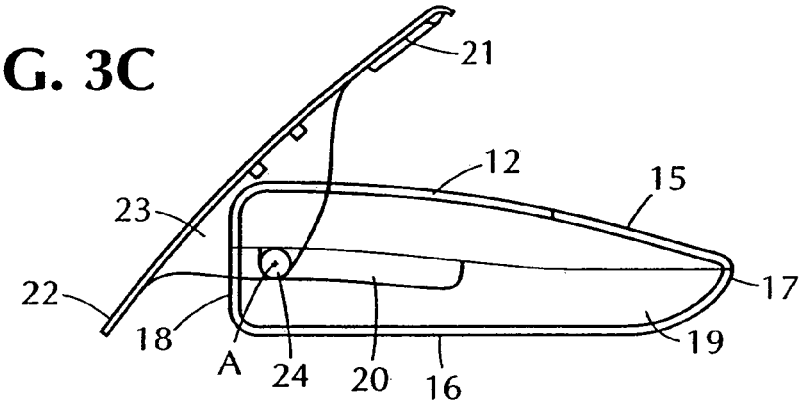
Figure 3D:
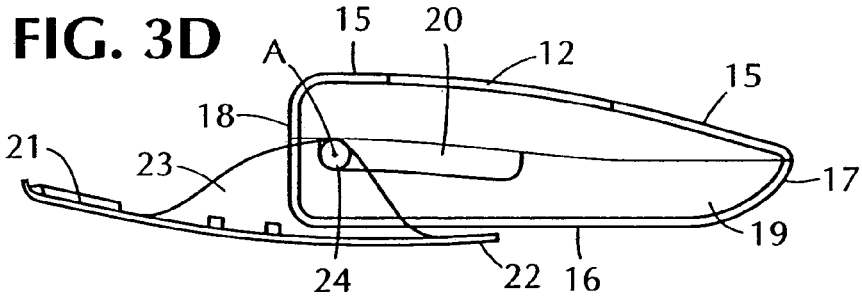

In addition to sliding, cover 14 can also be partly rotated about pivotal axis A when cover 14 is slid sufficiently rearward along grooves 20, as illustrated in FIGS. 1C, 1D, 2C, 2D, 3C and 3D. As shown in FIGS. 3A–3E and also by the dotted line in FIG. 5B, pivotal axis A is defined by the line joining the center points of projections 24 when projections 24 are at the rearmost position in grooves 20. Thus, pivotal axis A is parallel to planes including top 15, bottom 16, front wall 17, and rear wall 18, and pivotal axis A is perpendicular to side walls 19. As shown in FIG. 3A, if cover 14 is not slid sufficiently rearward along grooves 20, then rear flap portion 22 of cover 14 is blocked by top 15 of housing 11, and cover 14 will not be able to rotate about pivotal axis A. Only when cover 14 is slid sufficiently rearward, as shown in FIG. 3B, can rear flap portion 22 of cover 14 clear rear wall 18 of housing 11, such that cover 14 may be rotated, as shown in FIGS. 3C and 3D.

Figure 1B:
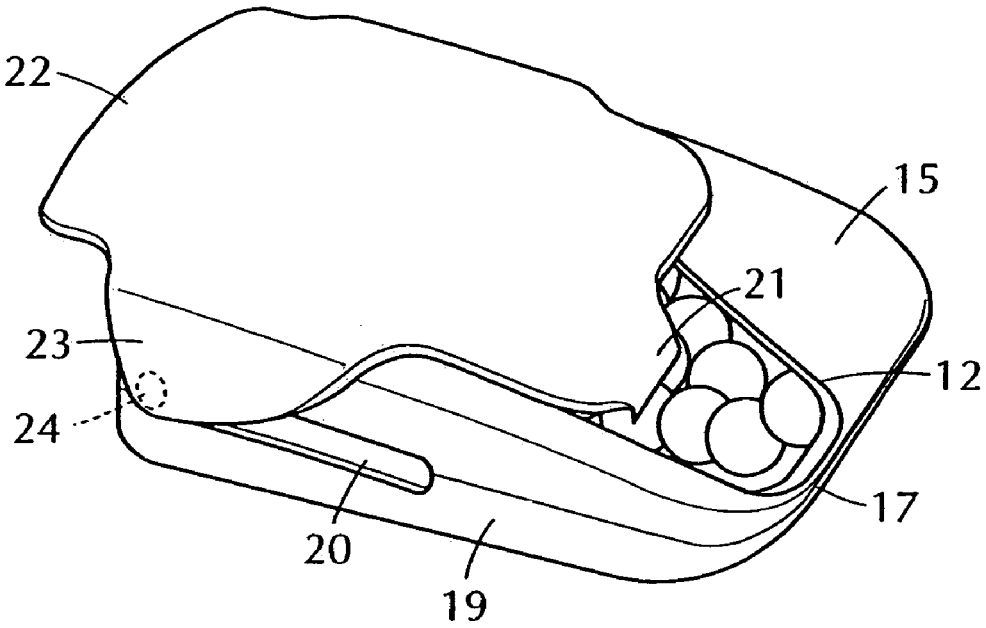
Figure 1C:
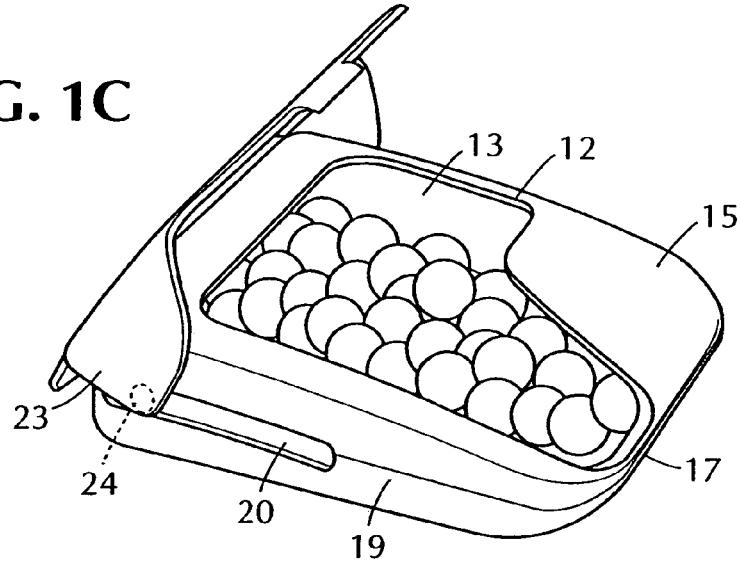
Figure 1D:
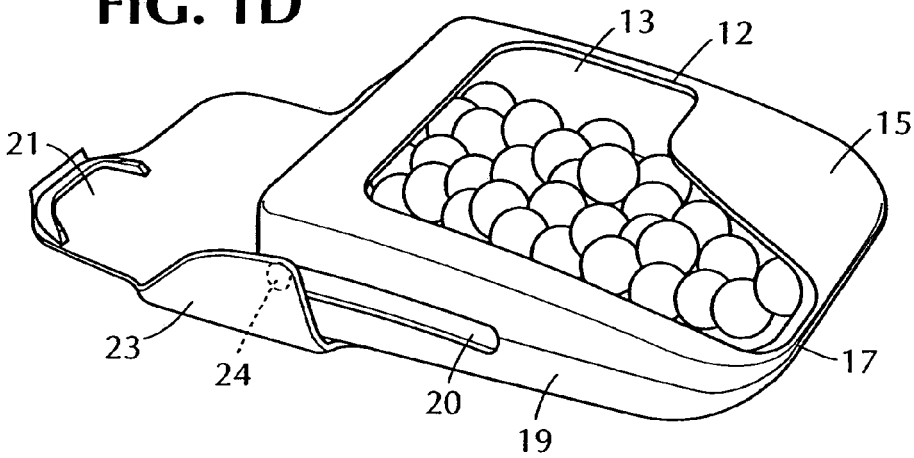
Figure 1E:
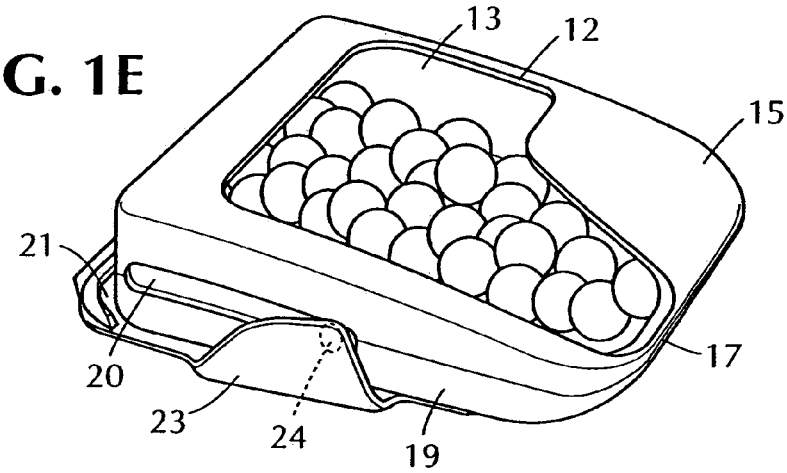
Figure 2A:
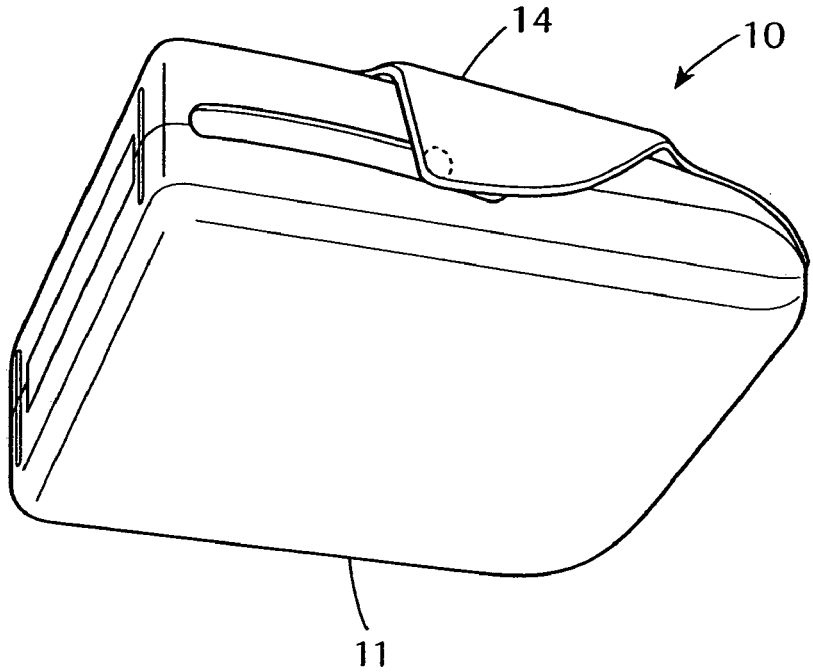
FIGS. 2A–2E are bottom perspective views of a dispenser of the invention, showing the cover of the dispenser in the same positions as shown in FIGS. 1A–1E, respectively.
Figure 2B:
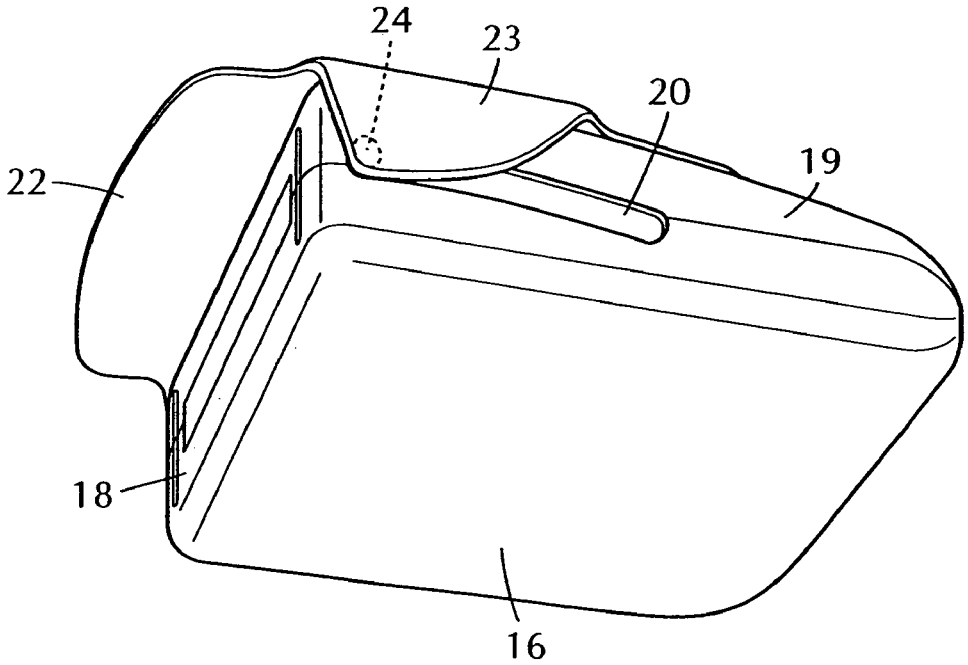
Figure 2C:
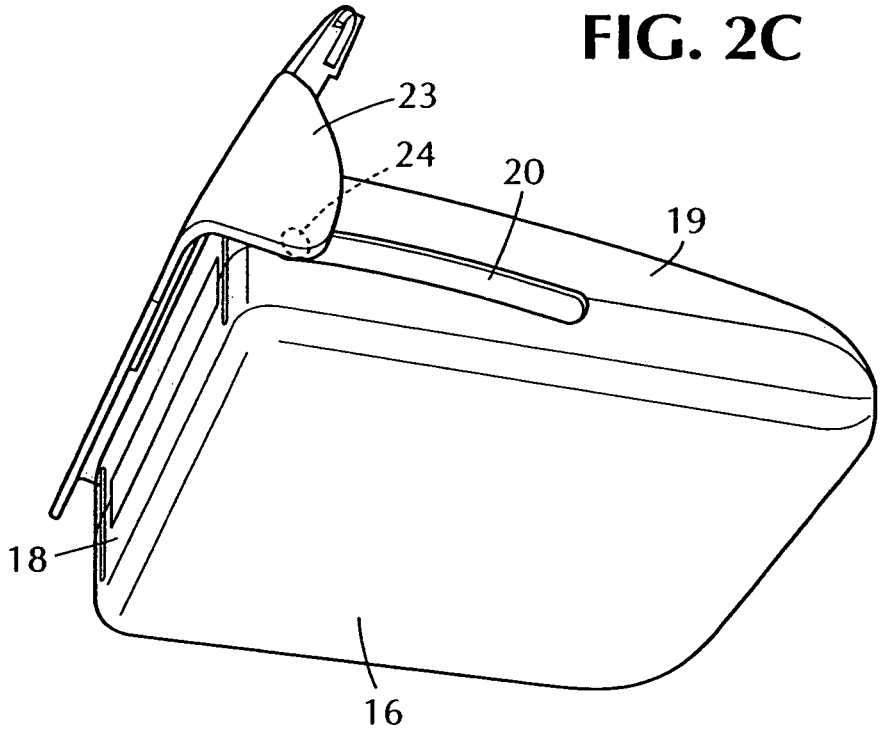
Figure 2D:
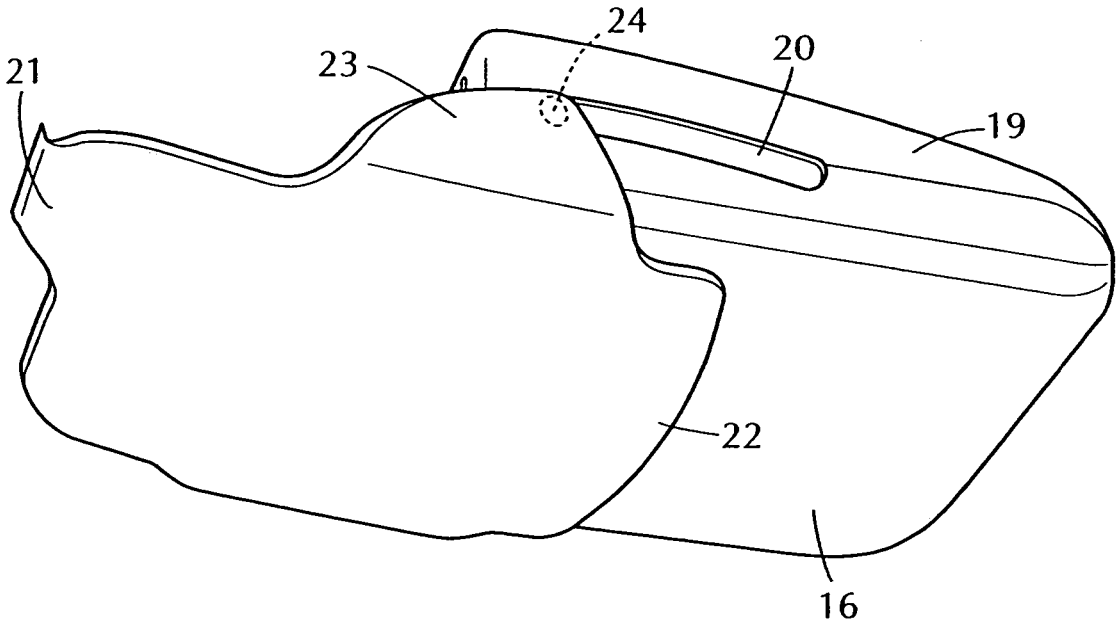
Figure 2E:
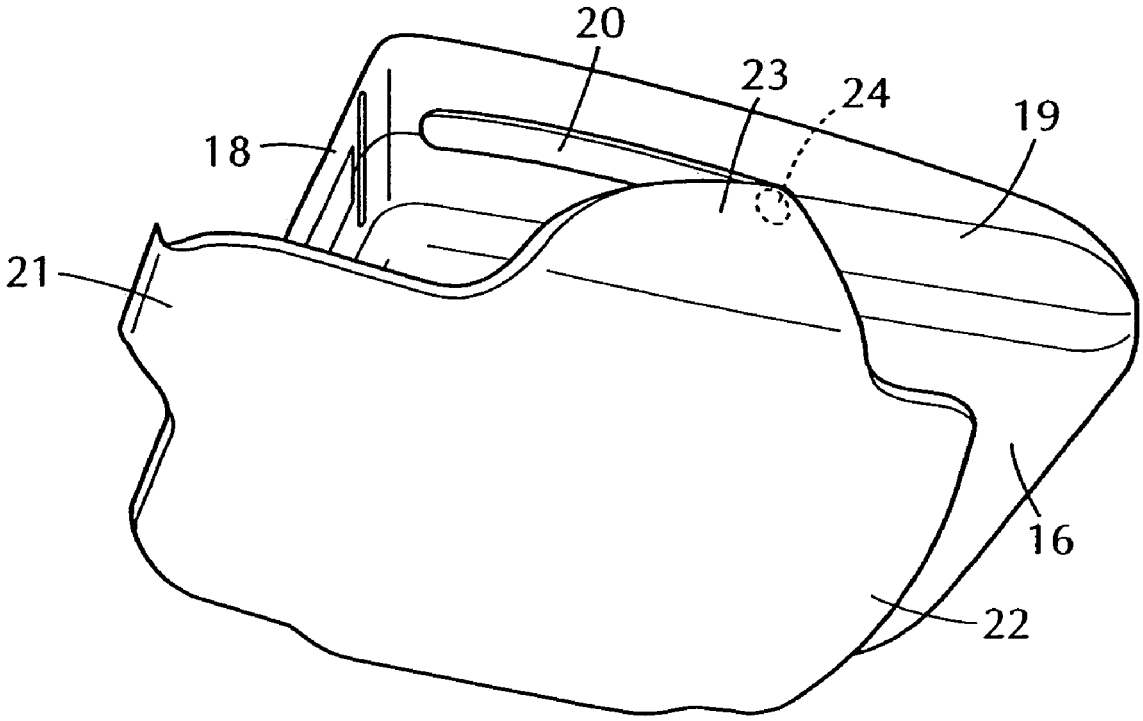
Figure 3E:
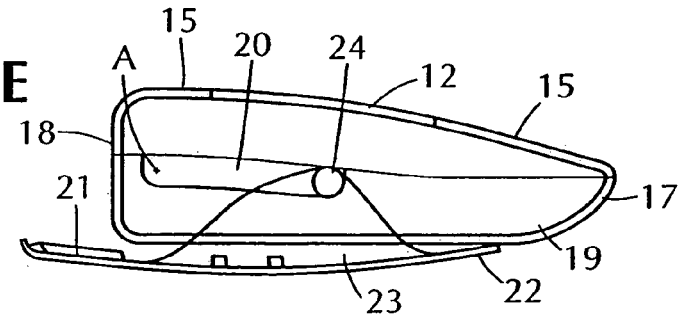

Thus, cover 14 can be positioned in a closed position (e.g. FIGS. 1A, 2A and 3A) or in any one of a plurality of opened positions (e.g. FIGS. 1B–1E, 2B–2E and 3B–3E). The closed position and at least some of the opened positions are stable positions such that, once the cover 14 is placed in such a position by the user, cover 14 will not easily slide out of the position of its own accord without the application of intentional force from the user. A first stable opened position is shown in FIGS. 1B, 2B and 3B. In this position, the cover is opened a small amount. This position is designed for dispensing or displaying single objects or small amounts of objects from the dispenser. A second stable opened position is shown in FIGS. 1E, 2E and 3E. In this position, the cover is fully opened and also stowed beneath the housing. This position is designed for dispensing or displaying large amounts of the objects in the dispenser. Because the dispenser allows for a plurality of opened positions, the convenience with which the dispenser may be used and the number of ways in which the dispenser may be used is increased. In addition, accidental spillage of the contents of the dispenser is avoidable because the dispenser admits of a stable opened position designed for dispensing single objects or small amounts of objects from the dispenser.

Moreover, since, as explained, cover 14 cannot be rotated until it is slid sufficiently rearward in grooves 20, cover 14 cannot be moved directly, that is, in a single, uninterrupted motion, from a completely closed position (e.g. FIGS. 1A, 2A and 3A) to a completely opened position (e.g. FIGS. 1D, 1E, 2D, 2E, 3D and 3E). This too prevents accidental spillage of the contents of the dispenser, precluding the dispenser from being suddenly—and without the user's intention—opened to a wide opened position.

After rotation about pivotal axis A, cover 14 may be again slid along grooves 20. Specifically, cover 14 may now be slid along grooves 20 so as to be stowed underneath housing 11, while dispenser 10 remains in a fully opened position. In the stowed position (FIGS. 1E, 2E and 3E), cover 14 is substantially flush with housing 11 and (except for the slight thickness of cover 14 itself) does not extend substantially beyond the boundaries of housing 11, i.e., beyond top 15, bottom 16, front wall 17, rear wall 18, and side walls 19, except for a small portion of cover 14 which extends beyond rear wall 18. In the stowed position, cover 14 is relatively unobtrusive and removed from view, and the dispenser as a whole retains its compact size. In this position, virtually the entire contents of dispenser 10 may be displayed and objects may easily be dispensed from dispenser 10 at a high dispensing rate. In addition, in this position, the exterior surfaces of dispenser 10 become almost as smoothed all over as they are when cover 14 is in the fully closed position (FIGS. 1A, 2A and 3A). That is, when cover 14 is in the fully opened and stowed position, as when cover 14 is in the fully closed position, the totality of exterior surfaces of dispenser 10 is relatively free of projections, rough edges, sharp corners, or the like, which could get caught in or snag a user's clothing or scratch a user's body.

As shown in FIGS. 4, 5A and 5B, cover 14 may also have one or more stops 25 provided on the underside of cover 14, a catch 26 on a leading edge of cover 14 (here shown on the leading edge of front tab portion 21), and a rib 27 on the underside of cover 14 toward the rear of cover 14. Stops 25 serve to stop cover 14 from sliding further forward when cover 14 has reached the fully closed position. Catch 26 serves to prevent cover 14 from opening (sliding backward) accidentally from a closed position, which could cause unwanted spillage. If catch 26 is provided, then cover 14 is lifted slightly to begin rearward sliding motion of cover 14 to open dispenser 10. Rib 27 serves to keep cover 14 from accidentally sliding backward, and hence to keep cover 14 fixed in position, when cover 14 is in the first stable opened position discussed above and illustrated in FIGS. 1B, 2B and 3B. Rib 27 also facilitates the rotation of cover 14, helping to stop cover 14 from continuing to slide backward and helping to translate the user's application of force to slide cover 14 rearward into a force acting to shift cover 14 upward so as to rotate cover 14.

The formation of dispenser 10 will now be discussed with reference to FIGS. 4, 6 and 7.

Housing 11 may be formed from a single piece of flexible material by, e.g., vacuum molding, injection molding, or blow molding. As shown in FIG. 6, housing 11 is preferably formed as a single piece comprising an upper portion 28 and a lower portion 29 joined by a living hinge 30. However, housing 11 can be formed as multiple pieces that are molded separately, and attached one to the other by any means known in the art, such as, e.g., a hinge comprising a pin that allows two pieces to be rotatably connected.

Figure 6:
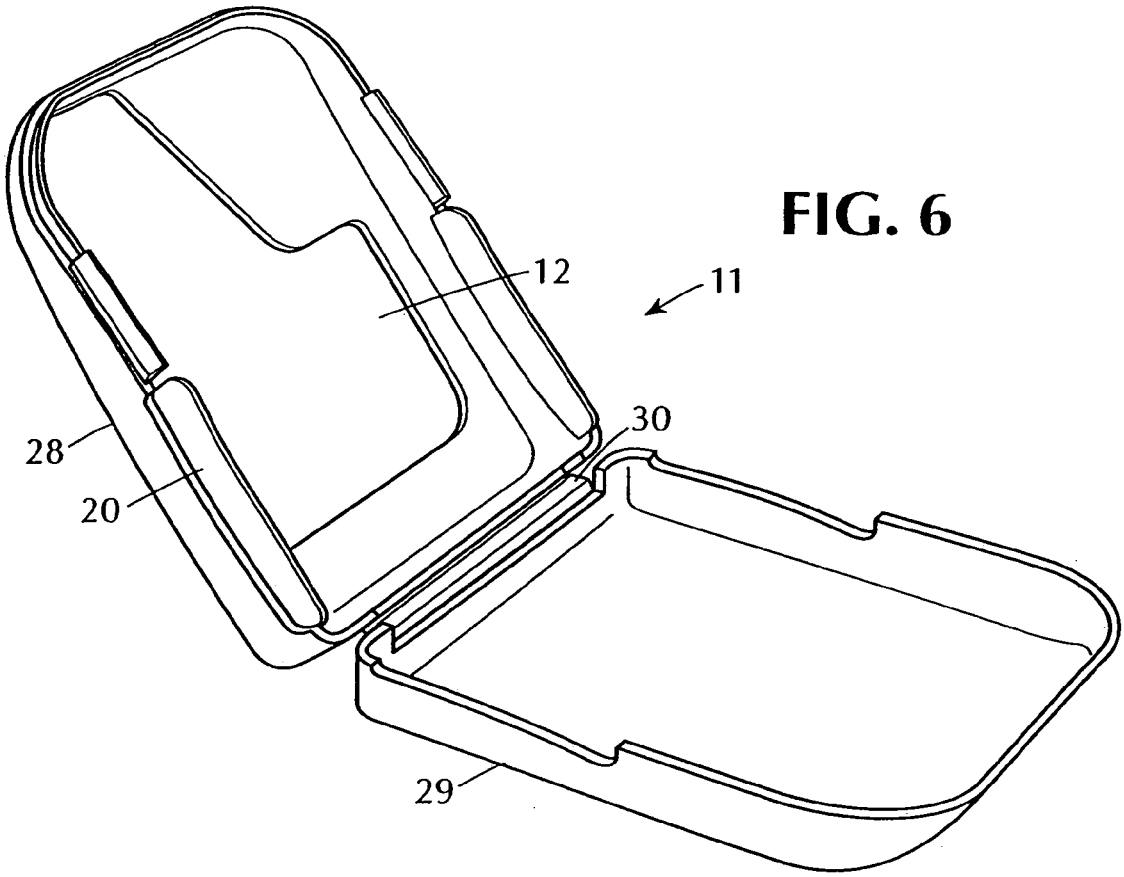
FIG. 6 is a perspective view showing a housing of a dispenser of the invention in an opened or unassembled state.

With housing 11 formed in the preferable manner identified, dispenser 10 may be filled either by opening housing 11 into its two component portions, as shown in FIG. 6, or by opening cover 14, as discussed above. Forming housing 11 as two connected portions also facilitates cleaning the interior of housing 11.

Figure 7:
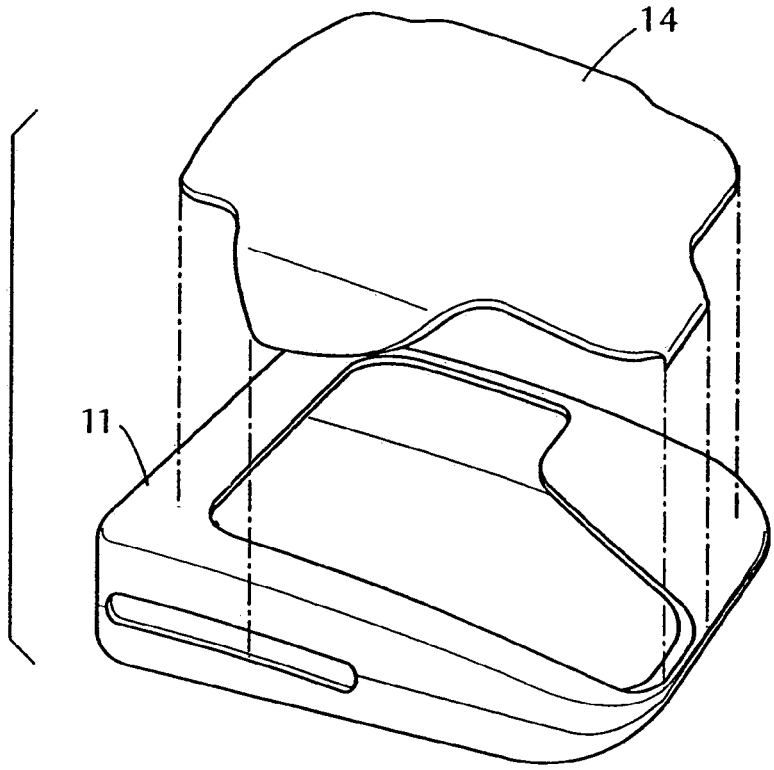
FIG. 7 is a perspective view showing how the cover of FIG. 4 is engaged with the housing of FIG. 6, when the housing of FIG. 6 is in a closed or assembled state.
Figure 8A:
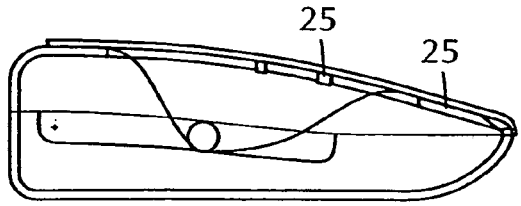
FIG. 8 is a schematic view for illustrating an embodiment of the invention in which the cover is fully stowed underneath the housing in an opened position, whereby the cover does not extend beyond the boundaries of the housing.
Figure 8B:
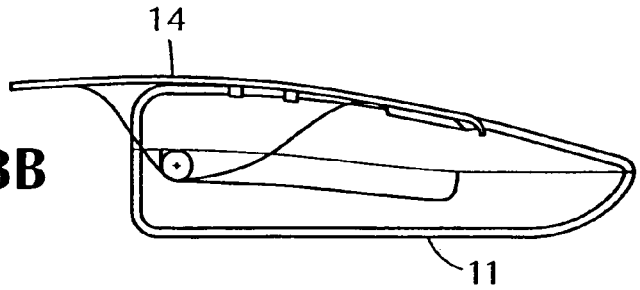
Figure 8C:
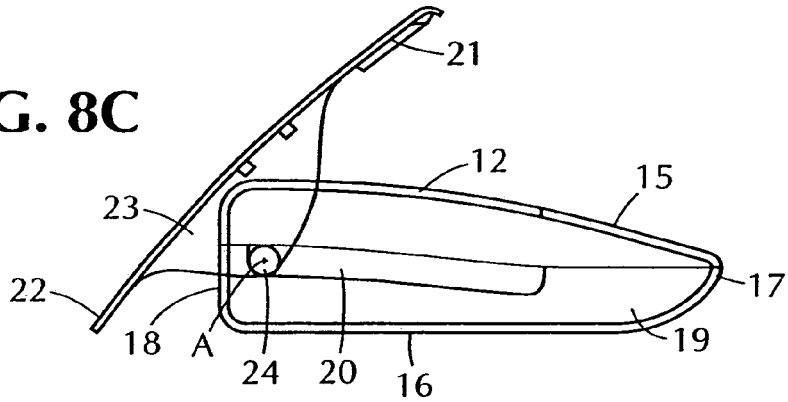
Figure 8D:
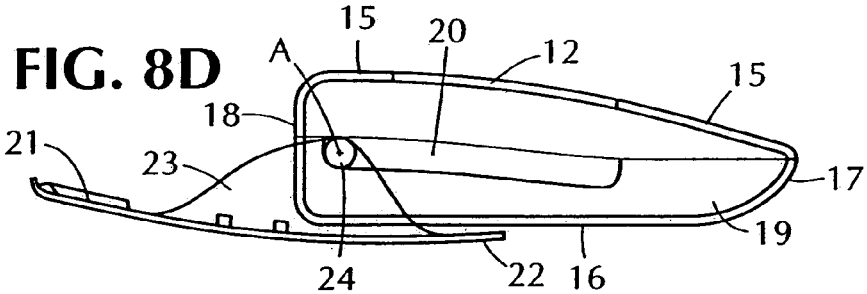
Figure 8E:
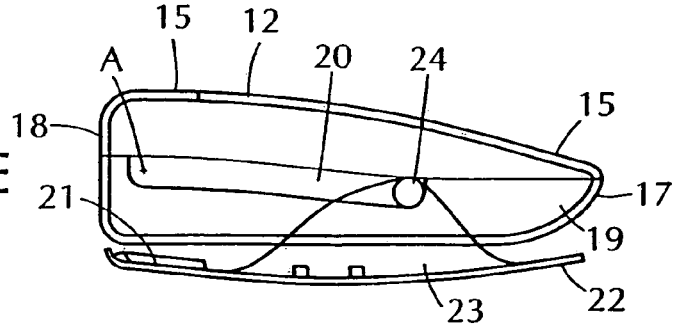

FIG. 4 shows cover 14 by itself, and FIG. 7 shows how cover 14 and housing 11 may be assembled together. Front tab portion 21, rear flap portion 22 and flanges 23 of cover 14 are preferably not separately formed elements, but formed simply as integral sections of cover 14, whereby front tab portion 21, rear flap portion 22, flanges 23 and the remainder of cover 14 constitute one continuous, smooth-surfaced member. However, these elements could be formed as separate pieces attached by any means known in the art.

As seen in FIG. 7, flanges 23 may be formed of material sufficiently flexible that a user may pull them outward from side walls 19, disengaging projections 24 from grooves 20, so that cover 14 may be removed entirely from housing 11, and later snapped back on. Of course, flanges 23 should be formed of a material sufficiently resilient, and/or grooves 20 should be sufficiently deep and projections 24 sufficiently long, that when cover 14 is engaged with housing 11, there is no danger of cover 14 accidentally coming apart from housing 11.

Housing 11, cover 14 and all of their component parts may be formed from any appropriate material, such as, e.g., polystyrene, polyvinyl chloride, or polypropylene. To allow viewing of the contents, housing 11 and/or cover 14 may be formed from a clear plastic, such as, e.g., polystyrene or clarified polypropylene.

Other Embodiments

FIG. 8 shows another embodiment of the dispenser of the invention. In the preceding embodiment, cover 14 is only partly stowed under housing 11, in the sense that a small portion of cover 14 including front tab 21 extends beyond the boundaries of housing 11, specifically, beyond the plane of rear wall 18. In the present embodiment, cover 14 may be fully stowed, in the sense that cover 14 does not extend beyond the boundaries of housing 11. Specifically, in the present embodiment, grooves 20 are made longer. That is, grooves 20 are formed so as to extend farther toward front wall 17. This allows cover 14, after rotation, to be slid along grooves 20 farther in the direction of front wall 17, so that cover 14 no longer extends beyond rear wall 18. In addition, in this embodiment, rear flap 22 of cover 14 is made slightly shorter so that, when cover 14 is thus slid farther along grooves 20 toward front wall 17, into the fully stowed position, rear flap 22 does not extend beyond the plane of front wall 17. In this way, cover 14 may be stowed such that it does not extend beyond the boundaries of housing 11. It is noted that extending grooves 20 in the direction of front wall 17 does not pose a problem of allowing cover 14 to be slid too far forward when the user is placing cover 14 in the closed position, because stops 25 prevent cover 14 from being slid too far forward, as shown in FIG. 5A.

Figure 9A:
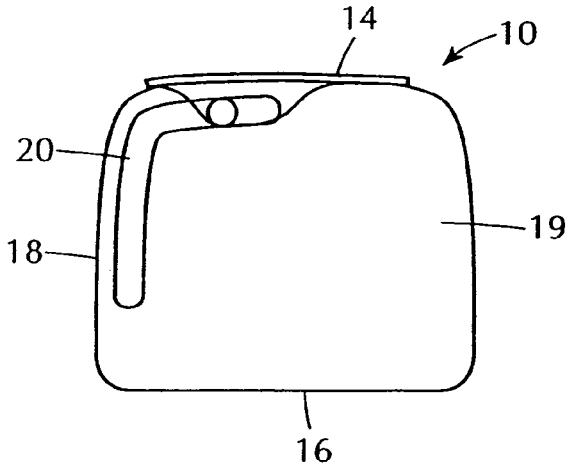
FIGS. 9A–9C are schematic views for illustrating an embodiment of the invention in which the dispenser is formed more in the shape of a cube and additional grooves are provided in the side walls of the housing, whereby the cover is stowed flush against the rear wall of the housing rather than against the bottom of the housing.
Figure 9B:
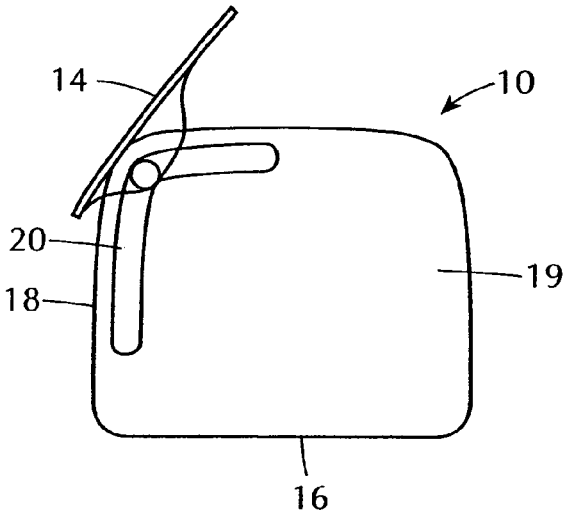
Figure 9C:
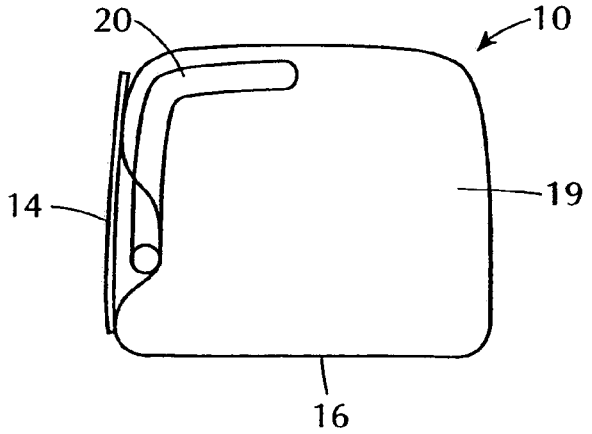

FIGS. 9A–9C illustrate another embodiment of the dispenser of the invention. In this embodiment, cover 14 is stowed flush against rear wall 18 rather than against bottom 16, as in the previous embodiments. This is achieved by forming dispenser 10 more in the shape of a cube and extending grooves 20 in side walls 19. Specifically, at the rearmost points of grooves 20, grooves 20 are extended, at a 90 degree angle, in the direction of bottom 16. In this arrangement, when cover 14 is slid back in grooves 20, cover 14 is rotated only 90 degrees and is then slid downward in the direction of bottom 16 along the extended portions of grooves 20. In this way, cover 14 may be stowed flush against rear wall 18 rather than against bottom 16.

Figure 10:
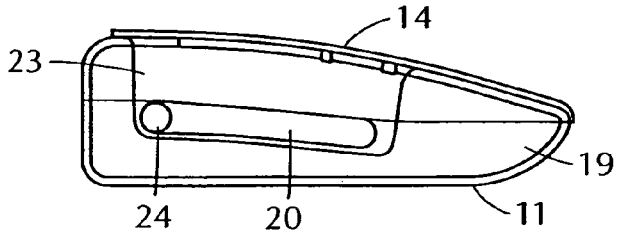
FIG. 10 is a schematic view for illustrating an embodiment of the invention in which grooves are provided on extended flanges of the cover and projections engaging the grooves are provided at the rear of the side walls of the housing.
Figure 11A:
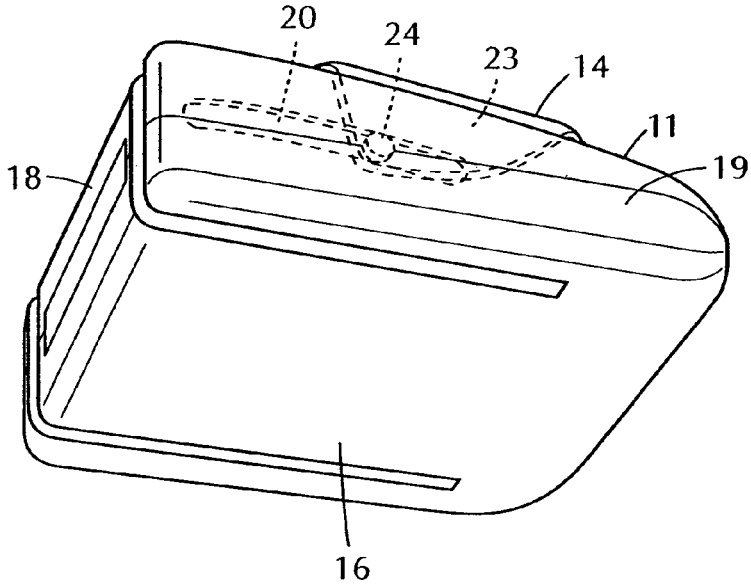
FIGS. 11A–11F are perspective views for illustrating an embodiment of the invention in which flanges of the cover hang down on the inside of the side walls of the housing, and grooves are formed on the inside of the side walls.
Figure 11B:
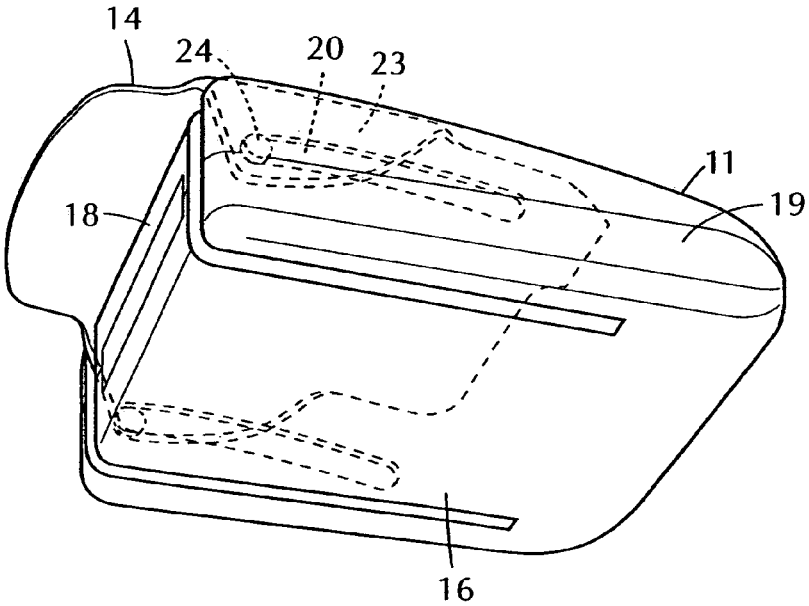
Figure 11C:
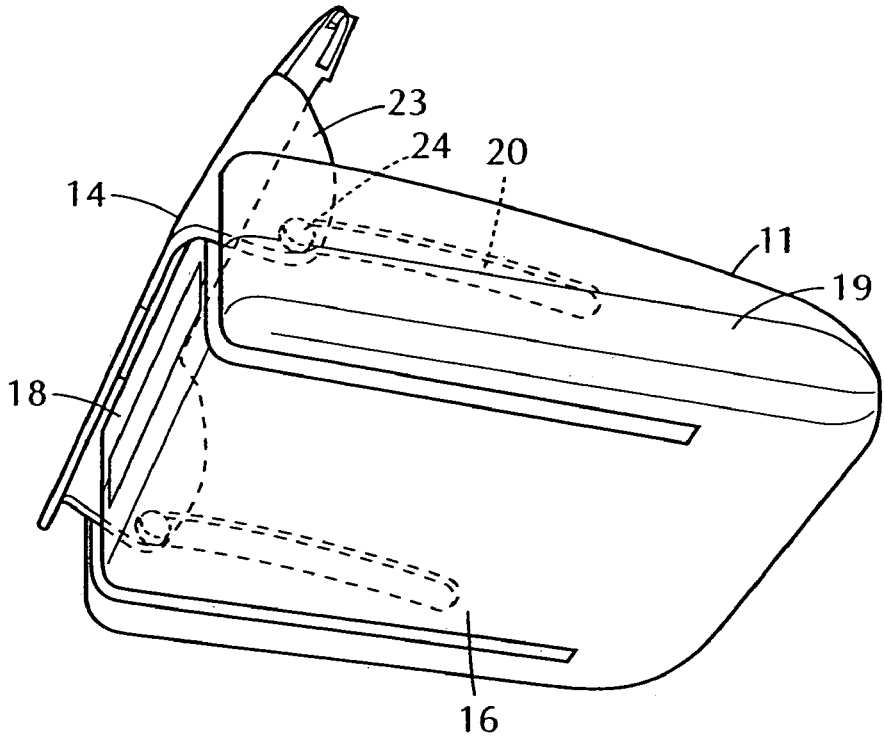
Figure 11D:
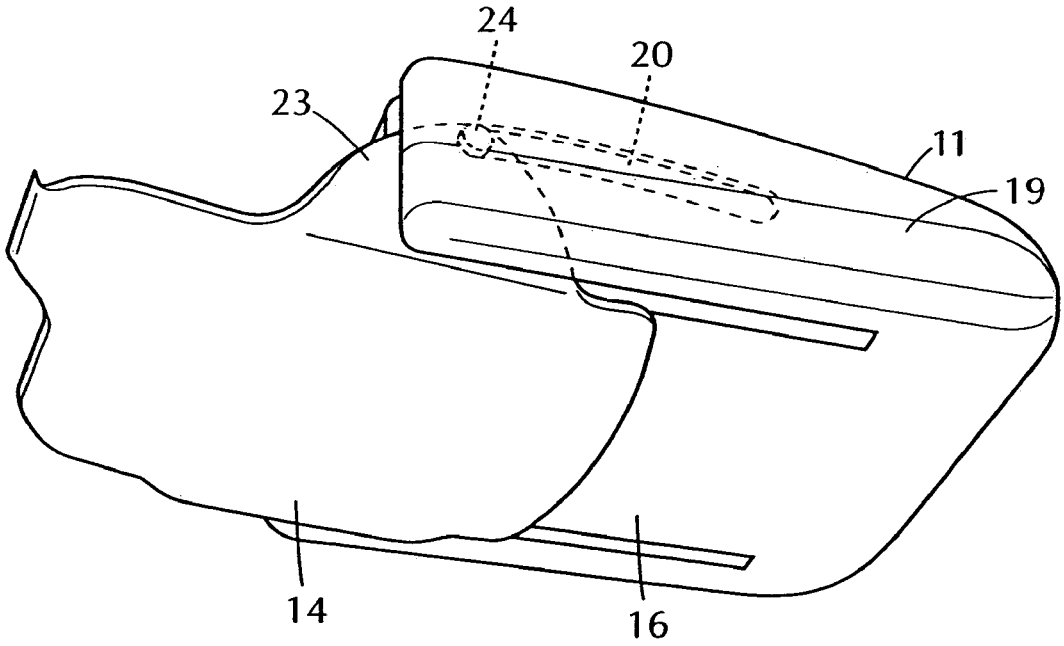
Figure 11E:
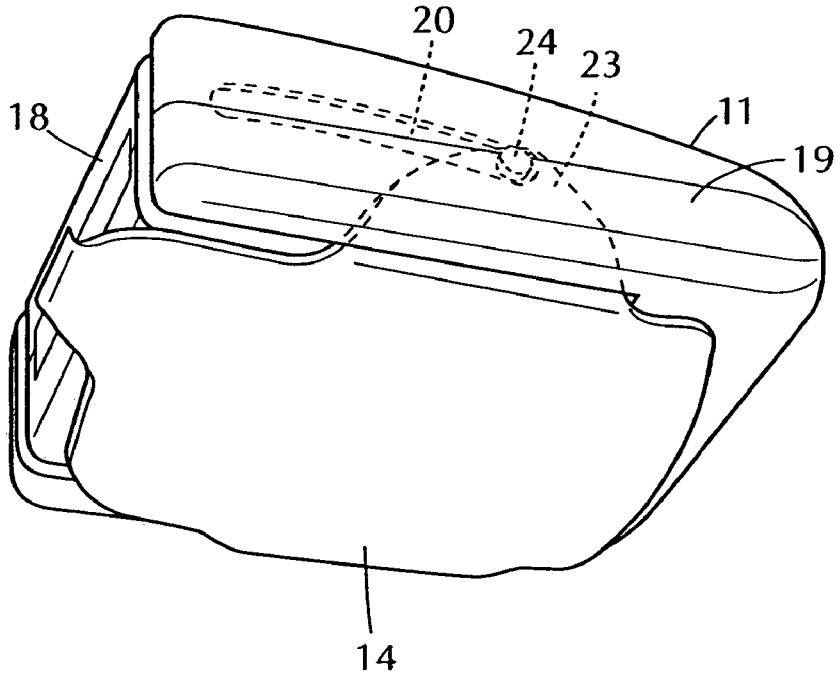
Figure 11F:
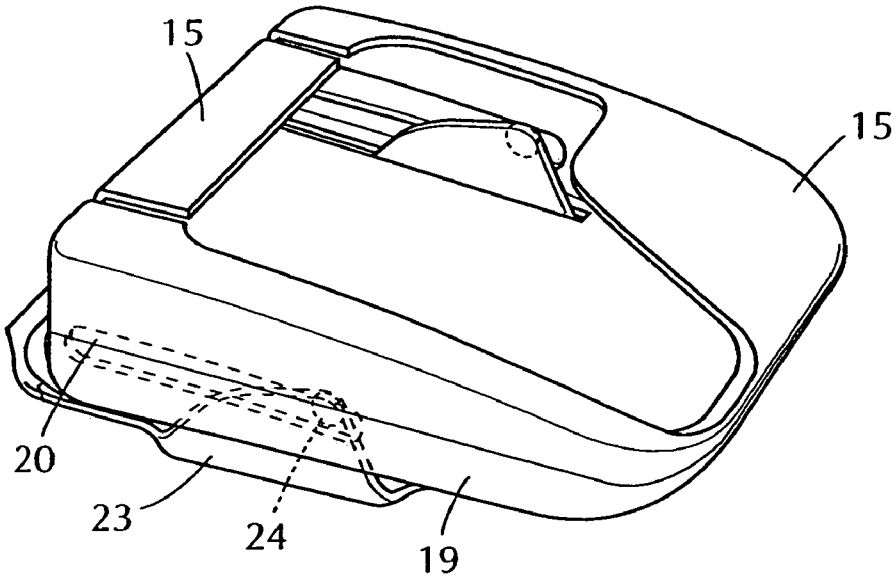

FIG. 10 shows another embodiment of the dispenser of the invention. In this embodiment, the position of grooves 20 and projections 24 are reversed. That is, grooves 20 are formed in cover 14, and projections 24 are formed on housing 11. In order to achieve this, flanges 23 of cover 14 are formed in a longer, rectangular shape so as to accommodate grooves 20. Projections 24 are provided at the rear of side walls 19 of housing 11.

FIGS. 11A–11F show another embodiment of the dispenser of the invention. In this embodiment, side flanges 23 hang down on the interior of side walls 19 of housing 11, rather than on the exterior. In addition, grooves 20 are formed on the interior of side walls 19 rather on the exterior. Each side flange 23 has a projection 24 provided therein facing a respective side wall 19, and projections 24 fit into grooves 20 such that cover 14 can slide back and forth along grooves 20. Continuous slots may be formed in top 15, rear wall 18 and bottom 16, as necessary to allow cover 14 to rotate as in the first embodiment.

This invention is not limited by the embodiments disclosed herein and it will be appreciated that numerous modifications and embodiments may be devised by those skilled in the art. Therefore, it is intended that the appended claims cover all such modifications and embodiments that fall within the true spirit and scope of the present invention.

What is claimed is:

1. A dispenser for storing and dispensing small objects, comprising:

a housing including a bottom, a front wall, a rear wall and two opposing side walls, said housing defining an interior volume and an aperture providing access to the interior volume;

a cover that is one continuous member, movably attached to said housing and having a closed position for securing objects within the interior volume and at least one opened position for displaying and/or dispensing the objects from the interior volume;

two flanges depending from said cover, said flanges being functionally engaged respectively with said sides walls of said housing such that said cover is laterally movable with respect to said housing in both the stowed and closed positions, selectively rotatable about an axis defined in said housing, and movable into the closed and opened positions including a stowed position in which said cover is opened and said cover is substantially flush with said bottom of said housing; and a groove provided on each of said side walls of said housing and a projection provided on each of said flanges, whereby said grooves and said projections are engagable with each other so as to allow said cover and said housing to selectively slide and rotate relative to one another wherein each of said grooves has a front end and an aft end, and the axis is defined by center points of said projections when said projections are at the aft ends of said grooves, respectively; and whereby said cover may be moved into the stowed position by first sliding said cover to the rearmost position, then rotating said cover about the axis to invert said cover, and then sliding said cover forward.

2. A dispenser as claimed in claim 1 wherein said cover is opened and in which said cover does not extend substantially beyond planes of said front wall and said side walls when said cover is in the stowed position.

3. A dispenser as claimed in claim 2, wherein said cover does not extend substantially beyond a plane of said rear wall when said cover is in the stowed position.

4. A dispenser as claimed in claim 1, wherein said housing further comprises a top, and said cover and said top partially overlap such that, when said cover is in the closed position, said cover and said housing cannot be rotated relative to one another until said cover is slid to a rearmost position in which said projections have slid to said aft ends of said grooves, respectively.

5. A dispenser as claimed in claim 1, further comprising a rib disposed on said cover and functionally engagable with said housing, wherein when said rib is functionally engaged with said housing, said cover is in a stable opened position.

6. A dispenser as claimed in claim 1, wherein said cover is removably attached to said housing.

7. A dispenser as claimed in claim 1, wherein said dispenser further comprises a locking means for locking said cover in a closed position.

8. A dispenser as claimed in claim 7, wherein said locking means comprises a releasable catch provided on said cover.

* * * * *